US007780109B1

(12) United States Patent
Park

(10) Patent No.: US 7,780,109 B1
(45) Date of Patent: Aug. 24, 2010

(54) ACCESSORY WRAPPING MACHINE

(76) Inventor: Gwang-Soo Park, 123-1201 Keun-Maul Daelim Apt., 121 Tanhyun-Dong, Ilsanseo-Gu, Goyang-Si, Gyeonggi-Do (KR)

( * ) Notice: Subject to any disclaimer, the term of this patent is extended or adjusted under 35 U.S.C. 154(b) by 0 days.

(21) Appl. No.: 12/466,196

(22) Filed: May 14, 2009

(51) Int. Cl.
*B21C 47/14* (2006.01)

(52) U.S. Cl. ..... 242/439.3; 242/439; 242/442

(58) Field of Classification Search ..... 242/437, 242/438.1, 439, 439.1, 439.2, 439.3, 442
See application file for complete search history.

(56) References Cited

U.S. PATENT DOCUMENTS 4,327,781 A * 5/1982 Zach ..... 140/124
4,597,419 A * 7/1986 Galloup et al. ..... 140/124
5,671,759 A * 9/1997 Chung et al. ..... 132/271
6,615,846 B1 * 9/2003 Leason et al. ..... 132/212
6,637,441 B2 * 10/2003 Kennedy et al. ..... 132/212
6,662,808 B2 * 12/2003 Leason et al. ..... 132/212
7,472,859 B2 * 1/2009 McMahan ..... 242/437
2003/0168074 A1 * 9/2003 Leason et al. ..... 132/212
2004/0237991 A1 * 12/2004 Glucksman et al. ..... 132/271

FOREIGN PATENT DOCUMENTS

KR 20000071968 A 12/2000

* cited by examiner

*Primary Examiner*—Emmanuel M Marcelo
(74) *Attorney, Agent, or Firm*—Volpe and Koenig P.C.

(57) ABSTRACT

Disclosed is an accessory wrapping machine for wrapping a string or a wire round a long band- or bar-shaped accessory member. With the present invention, it is possible to reduce a decoration time taken in wrapping an accessory with a string or a wire, make an outer appearance of a completed accessory beautiful, prevent a decorative string or wire drawn out of a reel from getting tangled when a motor pauses and restarts in a process of wrapping the decorative string or wire round an accessory member, and wrap the accessory member with the string or wire uniformly and at constant tension.

7 Claims, 7 Drawing Sheets

ACCESSORY WRAPPING MACHINE

FIELD OF INVENTION

The present invention relates to an accessory wrapping machine, and more particularly to an accessory wrapping machine device for winding various strings or wires from a wrapping reel round a long band- or bar-shaped accessory member, which allows the shape of the accessory member or the wire wound around the accessory member to be changed as desired in manufacturing an accessory, thereby not only reducing time taken in wrapping work but also preventing the string or wire drawn out of the wrapping reel from getting tangled and wrapping the string or wire round the accessory member with constant tension.

BACKGROUND

In general, accessories are innumerable and manifold, but their materials can be broadly classified into metal and a synthesis resin.

Further, the accessories may be sorted into a product using an automatic mechanical chain, a pressed product, a casting product, etc.

Here, the product using the automatic mechanical chain refers to decorative accessories having various shapes, in which a wire is cut and processed to form O-shaped chain elements by an automatic machine, the chain elements are chained with each other to form a chain, and the chain is processed again to complete the decorative accessory. The pressed product refers to a product produced from a desired mold by compressing a material, and the casting product refers to a product completed by pouring a molten material into a carved mold dividable into two parts, in which the decorative accessory may have various shapes depending on the mold shapes and the carved shapes.

In particular, an accessory geometrically changed from a ring or band shape, e.g., a bracelet, a necklace, an earring, a cellular accessory or the like is wrapped with a string or wire, so that it can feel a texture of material. However, conventionally, the accessory has to undergo hand-processing to be wrapped with the string or the wire, and thus it takes relatively so much time for individual decoration.

Similarly, there has been disclosed a device for wrapping a hair with a decorative string, in Korean Patent No. 10-0344176 (Jul. 2, 2002).

According to the disclosed device, in a process of wrapping the decorative string round the hair, the string drawn out of a reel may get tangled when a motor pauses and restarts, so that the hair can be wrapped with the string non-uniformly and at inconstant tension.

SUMMARY

Accordingly, an aspect of the present invention is to provide an accessory wrapping machine capable of wrapping a string or a wire round an accessory so that a surface of the accessory geometrically changed from a ring or band shape material can feel a texture of material.

Another aspect of the present invention is to provide an accessory wrapping machine capable of reducing a decoration time taken in wrapping an accessory with a string or a wire.

Still another aspect of the present invention is to provide an accessory wrapping machine which can prevent a decorative string or wire drawn out of a reel from getting tangled when a motor pauses and restarts in a process of wrapping the decorative string or wire round an accessory member, and wrap the accessory member with the string or wire uniformly and at constant tension.

Additional aspects and advantages of the present invention will be set forth in part in the description which follows and, in part, will be obvious from the description, or may be learned by practice of the invention based on means from and combination of claims.

The foregoing and/or other aspects of the present invention may be achieved by providing an accessory wrapping machine for wrapping a string or a wire round a long band- or bar-shaped accessory member, the accessory wrapping machine comprising: a gripper in which a bracket formed with a first through hole to pass the accessory member protrudes at a side thereof; a wrapping reel rotator which is rotatably coupled at a side of the bracket, and comprises a second through hole to pass the accessory member, a receiving groove to receive a wrapping reel round which the string or wire is wound, and a cutting portion formed by partially cutting a lateral side of the receiving groove; and a guider which is hinge-coupled to a side of the wrapping reel rotator to open/close the cutting portion, and comprises a clamping unit formed at a free end thereof to surround and support the accessory member, a guiding groove spirally recessed from the cutting portion along an outer surface to form a drawing-out path of the string or wire wound round the wrapping reel, and a separation preventing unit to open/close the guiding groove.

The separation preventing unit may be inserted in the guiding groove, and formed with an insertion hole in which the string or wire is inserted.

The separation preventing unit may be formed to surround the outer surface of the guider.

The separation preventing unit may be hooked to the guider so that the separation preventing unit can be attached to and detached from the guider.

The separation preventing unit may be sliding-coupled to the guider so that the separation preventing unit can slide in the guider to adjust a space between the guiding groove and the separation preventing unit.

BRIEF DESCRIPTION OF THE DRAWINGS

These and/or other aspects and advantages of the present invention will become apparent and more readily appreciated from the following description of the embodiments, taken in conjunction with the accompanying drawings of which.

DETAILED DESCRIPTION OF THE PREFERRED EMBODIMENTS

For reference, a first exemplary embodiment of the present invention will be representatively described, and other exemplary embodiments will be described with regard to only different configurations from those of the first exemplary embodiment, in which like numerals refer to like elements throughout.

Below, an accessory wrapping machine according to an exemplary embodiment of the present invention will be described with reference to accompanying drawings.

Figure 1:
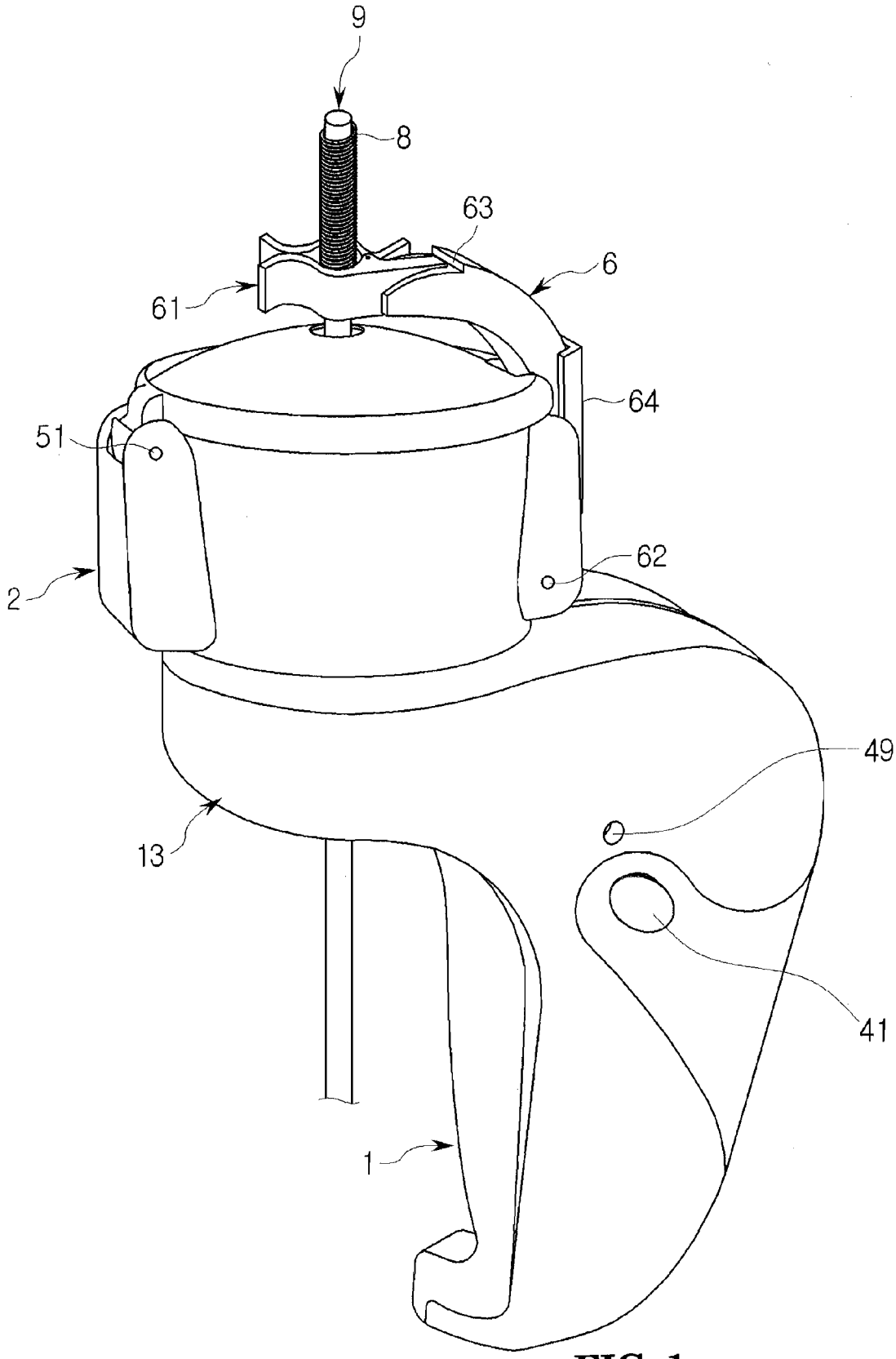
FIG. 1 is a perspective view of an accessory wrapping machine according to an exemplary embodiment of the present invention.
Figure 2:
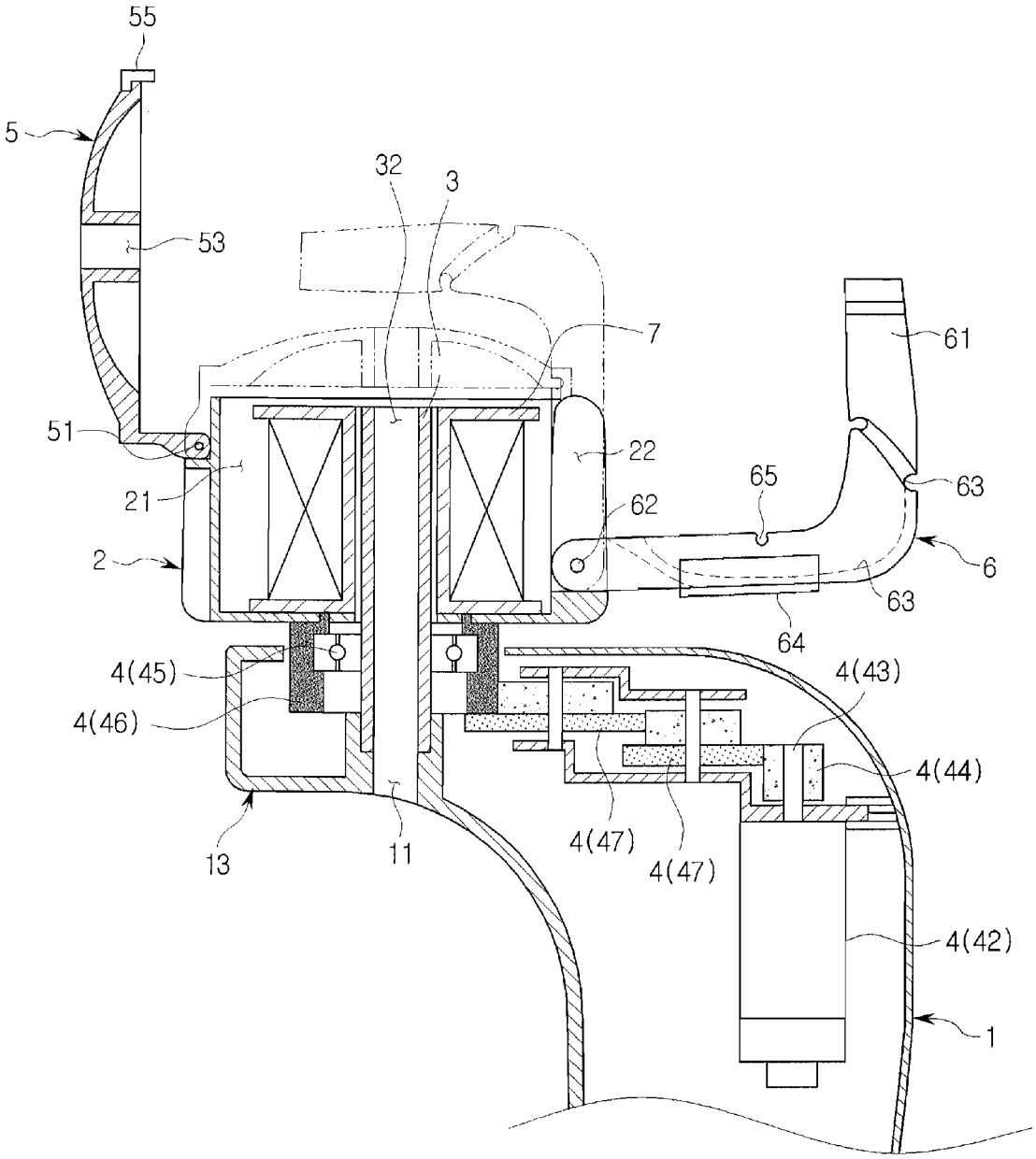
FIG. 2 is a sectional view of the accessory wrapping machine according to an exemplary embodiment of the present invention.

FIG. 1 is a perspective view of an accessory wrapping machine according to an exemplary embodiment of the present invention, and FIG. 2 is a sectional view of the accessory wrapping machine according to an exemplary embodiment of the present invention.

Referring to FIGS. 1 and 2, an accessory wrapping machine according to an exemplary embodiment of the present invention is a device for wrapping a long band- or bar-shaped accessory member 9 with a string or wire 8, which comprises a gripper 1, a wrapping reel rotator 2, and a guider 6.

As shown therein, the gripper 1 may have an inverse "L"-shape or an "I"-shape in a form that a bracket 13 protrudes at a side thereof. Here, the bracket 13 is formed with a first through hole 11 through which the accessory member 9 passes.

The wrapping reel rotator 2 is rotatably coupled to the bracket 13 of the gripper 1. The wrapping reel rotator 2 has a receiving groove 21 to receive a wrapping reel 7 round which the string or wire 8 is wound, and a cutting portion 22 that a lateral side of the receiving groove 21 receiving the wrapping reel 7 is partially opened. Here, the wrapping reel 7 is centrally-hollowed to receive a holder 3, so that it can be stably accommodated in the receiving groove 21 of the wrapping reel rotator 2.

The holder 3 which is centrally-hollowed includes a first side inserted in and fastened to the first through hole 11 of the bracket 13, and a second side allowing the hollow wrapping reel 7 to be inserted therein via the receiving groove 21 of the wrapping reel rotator 2. Thus, the centrally-hollowed part of the holder 3 becomes a second through hole 32, so that the accessory member 9 inserted in the first through hole 11 can pass through the second through hole 32.

Also, the gripper 1 is internally provided with a driver 4 so that the wrapping reel rotator 2 can rotate in the bracket 13.

The driver 4 generally includes a motor 42, a driving unit 44, a bearing 45, and a driven unit 46. The motor 42 rotates a driving shaft 43 by applied power, and is turned on/off by manipulation of a switch 41 exposed in the gripper 1. Further, a charging terminal (not shown) is provided at a side of the gripper 1 so that the motor 42 can receive external power via the charging terminal (not shown) and a rechargeable battery (not shown) embedded in the gripper 1 can be charged through the charging terminal (not shown). In the case where the rechargeable battery is charged and used, portability is improved. Also, a charging indicating lamp 49 is provided in the gripper 1, so that a charged state can be checked through the charging indicating lamp 49 while the rechargeable battery is charged. Further, the driving unit 44 is coupled to the driving shaft 43 of the motor 42, so that a rotational force of the motor 42 can be transmitted. Meanwhile, the bearing 45 is coupled to the holder 3, and the driven unit 46 coupled to the bearing 45 is linked to the driving unit 44, thereby transmitting the rotational force of the motor 42. The driven unit 46 is coupled and fastened to the wrapping reel rotator 2, so that the motor 42 can rotate the wrapping reel rotator 2.

The driving unit 44 and the driven unit 46 may be gear-coupled as shown in the drawings, and thus a connection gear 47 may be formed between the driving unit 44 and the driven unit 46. Alternatively, the driving unit 44 and the driven unit 46 may use combination between a belt and a pulley to thereby transmit the rotational force from the motor 42 to the driven unit 46. The driver 4 is enough as long as it can rotate the wrapping reel rotator 2 through a motor or the like rotation unit.

Additionally, a cover 5 may be provided to open and close the receiving groove 21 of the wrapping reel rotator 2.

The cover 5 is hinge-coupled to a side of the wrapping reel rotator 2 by a first hinge shaft 51 and rotates with respect to the first hinge shaft 51, thereby opening and closing the receiving groove 21. The cover 5 includes a third through hole 53 through which the accessory member 9 passed via the second through hole 32 formed in the holder 3 passes, and a first locking unit 55 formed at an edge of the cover 5 to lock the cover 5 through the guider 6 (to be described later). In consideration of the guider 6 formed in the cutting portion 22 of the receiving groove 21, the first locking unit 55 may be formed at a corresponding position to the cutting portion 22 of the receiving groove 21.

Figure 3:
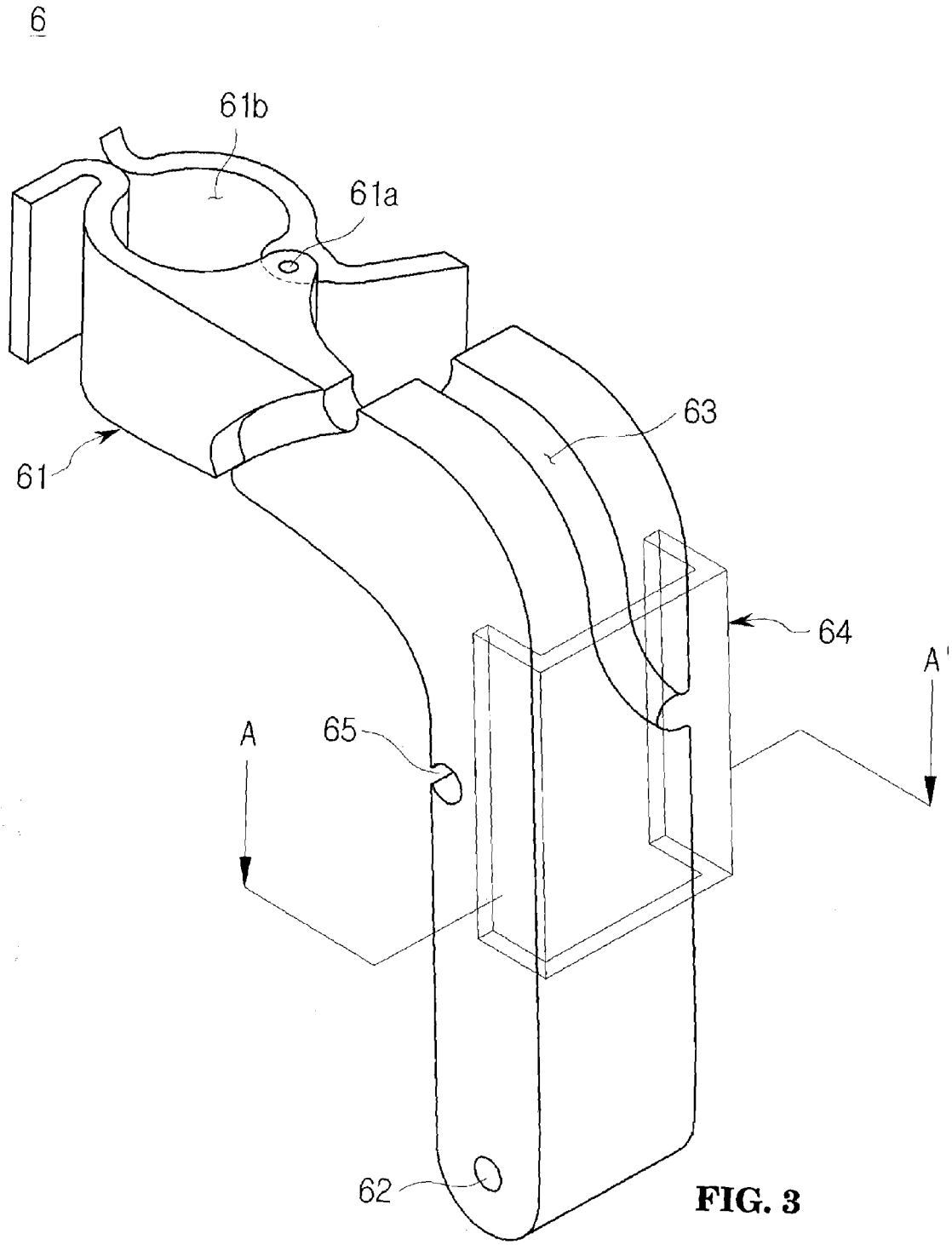
FIG. 3 is a perspective view of a guider in the accessory wrapping machine according to an exemplary embodiment of the present invention.

FIG. 3 is a perspective view of a guider in the accessory wrapping machine according to an exemplary embodiment of the present invention. Referring to FIG. 3, when the wrapping reel 7 is seated in the receiving groove 21 and then the string or wire 8 wound on the wrapping reel 7 is drawn out through the cutting portion 22, the guider 6 guides the drawn-out string or wire 8 to reach the accessory member 9 stably.

The guider 6 is hinge-coupled to a side of the wrapping reel rotator 2 by a second hinge shaft 62 and opens and closes the cutting portion 22 of the receiving groove 21. The guider 6 includes a guiding groove 63, a clamping unit 61, and a separation preventing unit 64. In addition, the guider 6 includes a second locking unit 65 to lock the cover 5.

The guiding groove 63 forms a drawing-out path of the drawn-out string or wire 8, which is recessed spirally along an outer surface from a surface facing the cutting portion 22 to the clamping unit 61. Here, the spiral direction of the guiding groove 63 may be determined depending on the rotational direction of the wrapping reel rotator 2, a string-winding direction of the wrapping reel 7, etc.

The clamping unit 61 is formed at a free end of the guider 6 and surrounds and supports the accessory member 9 passed through the first, second and third through holes 11, 32 and 53. The clamping unit 61 is provided in the form of facing each other with a pivot shaft 61*a* therebetween, and operates like a seesaw, surrounding the accessory member 9. The pivot shaft 61*a* is provided with an elastic unit (not shown) such as a spring, so that members separated by the seesaw operation can return to an original position by elasticity and come in contact with each other. Further, a supporting groove 61*b* is formed at a portion where the accessory member 9 is supported, thereby preventing the accessory member 9 from separating. The clamping unit 61 may have the same or similar configuration as a clothespin for fastening clothes hung up on a clothes line.

Figure 4:
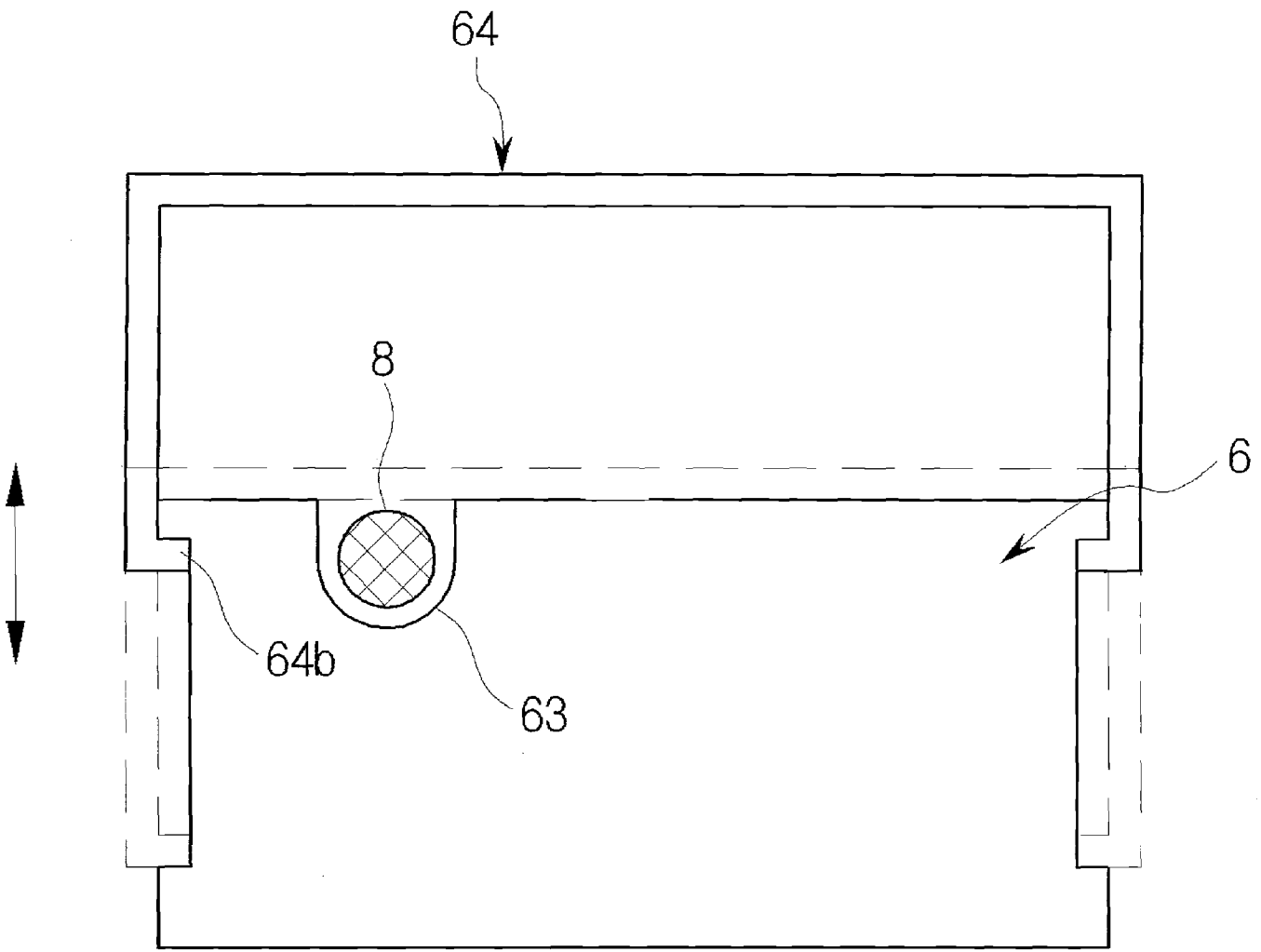
FIG. 4 is a sectional view of a first variant example of the guider taken along line A-A' in FIG. 3.
Figure 5:
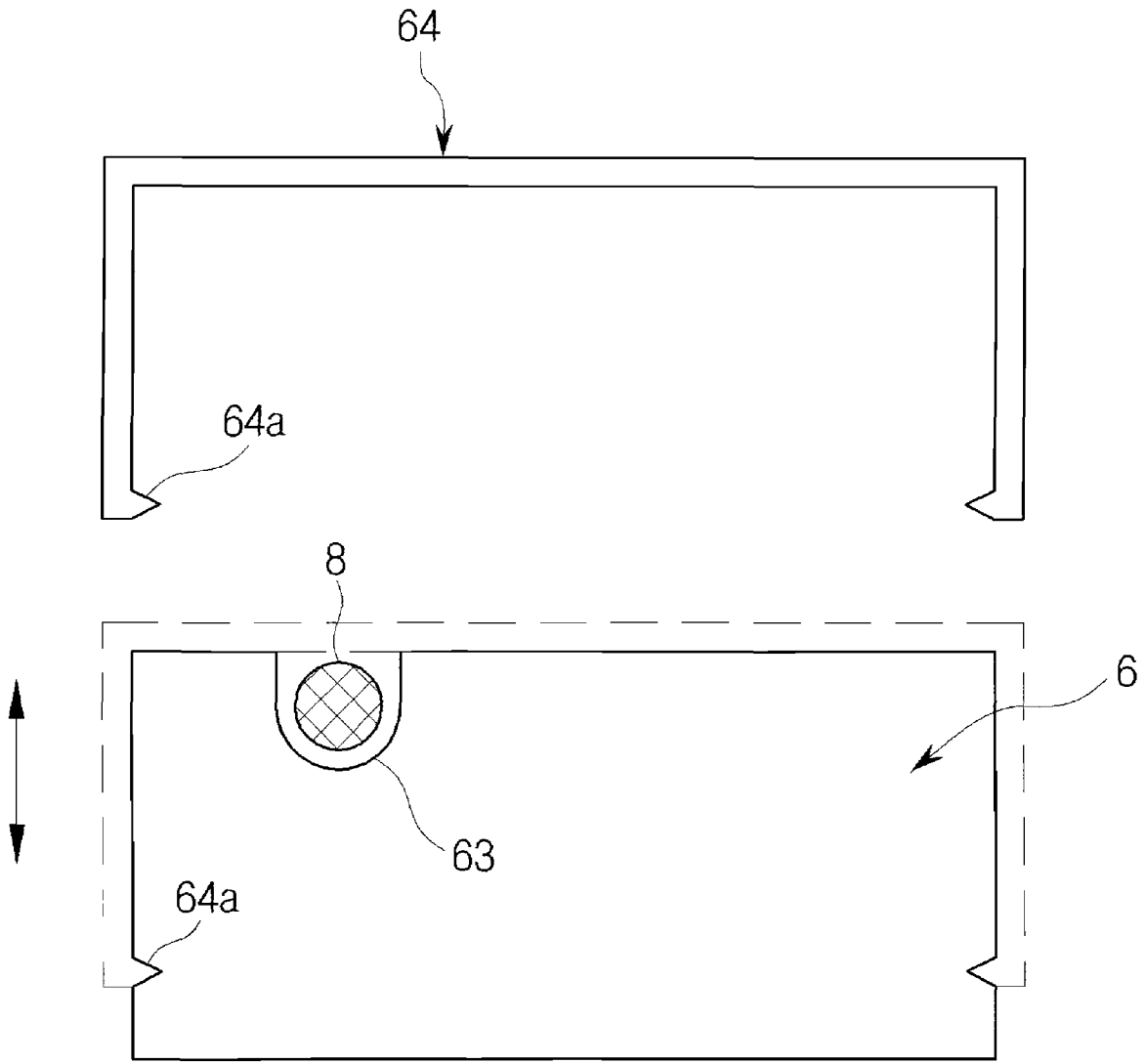
FIG. 5 is a sectional view of a second variant example of the guider taken along line A-A' in FIG. 3.
Figure 6:
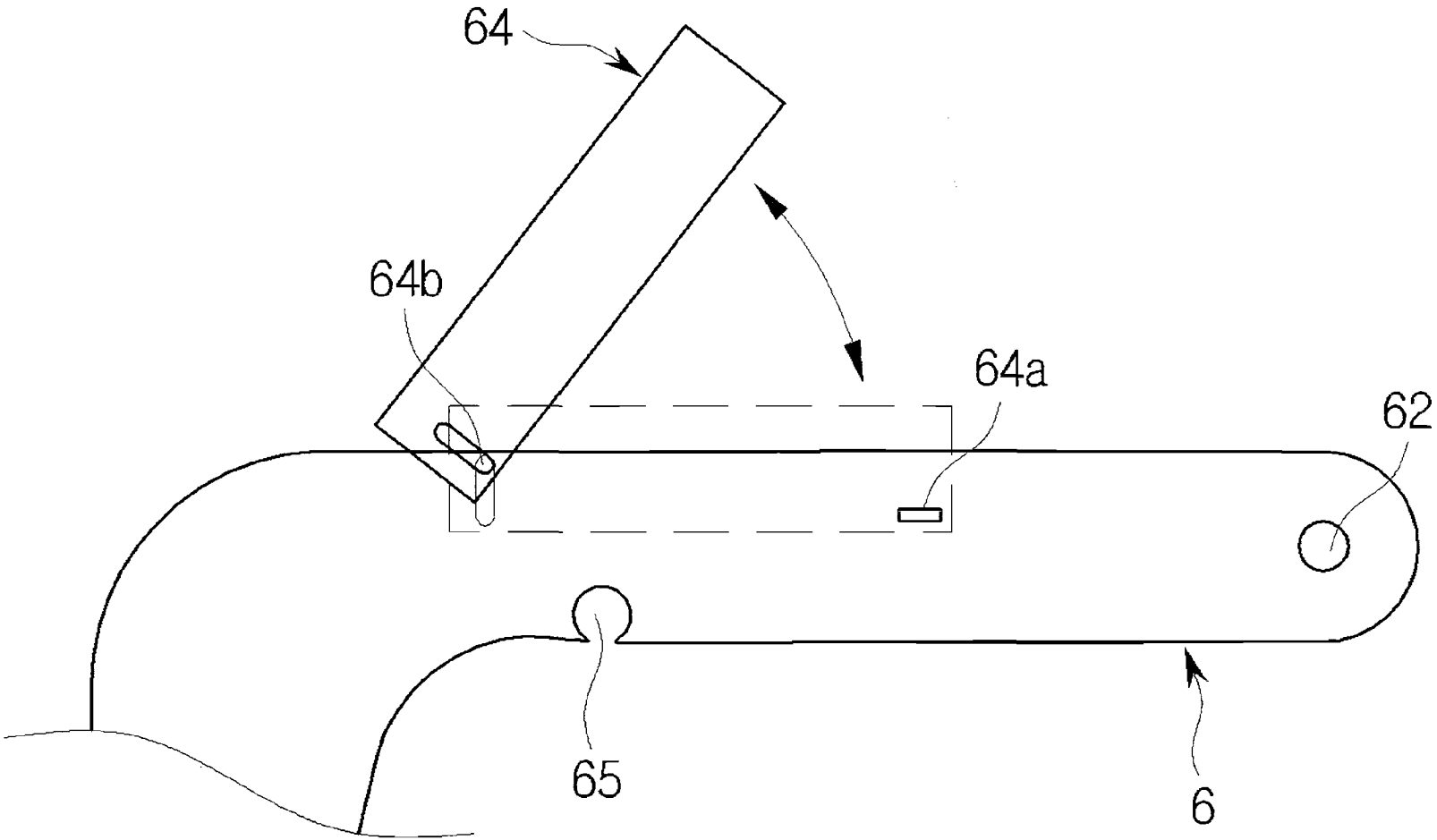
FIG. 6 is a lateral view of a third variant example of the guider in the accessory wrapping machine according to an exemplary embodiment of the present invention.
Figure 7:
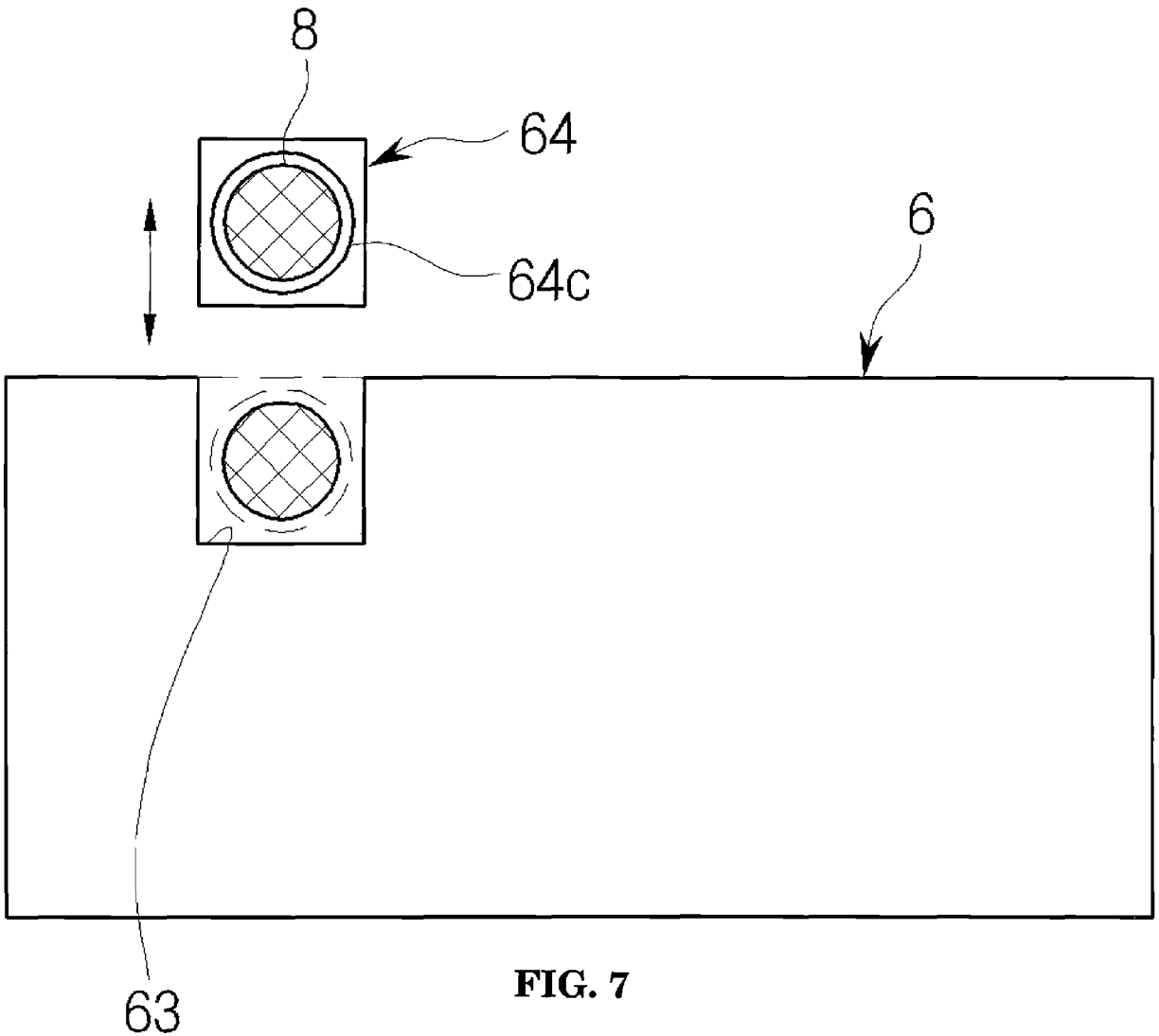
FIG. 7 is a sectional view of a fourth variant example of the guider in the accessory wrapping machine according to an exemplary embodiment of the present invention.

FIGS. 4 to 7 illustrate variant examples of the separation preventing unit according to exemplary embodiments of the present invention, in which FIG. 4 is a sectional view of a first variant example of the guider taken along line A-A' in FIG. 3; FIG. 5 is a sectional view of a second variant example of the guider taken along line A-A' in FIG. 3; FIG. 6 is a lateral view of a third variant example of the guider in the accessory wrapping machine according to an exemplary embodiment of the present invention; and FIG. 7 is a sectional view of a fourth variant example of the guider in the accessory wrapping machine according to an exemplary embodiment of the present invention. Here, at least one separation preventing unit 64 is formed to open/close the guiding groove 63 formed in the guider 6.

The separation preventing unit 64 may be formed to surround the outer surface of the guider 6 as shown in FIGS. 4 to 6.

Referring to FIG. 4, the separation preventing unit 64 may include a sliding unit 64*b* (a slider and a slide groove) provided at opposite end parts of the separation preventing unit 64 surrounding the guider 6 and at lateral sides of the guider 6 facing thereto, respectively. Thus, a space between the separation preventing unit 64 and the guiding groove 63 can be adjustable according to sliding of the separation preventing unit 64.

Referring to FIG. 5, the separation preventing unit 64 may include a hooking unit 64*a* (a hooking projection and a hooking groove) provided at opposite end parts of the separation preventing unit 64 surrounding the guider 6 and at lateral sides of the guider 6 facing thereto, respectively. Thus, the separation preventing unit 64 can be attached to or detached from the guider 6.

Referring to FIG. 6, the separation preventing unit 64 may include both the sliding unit 64*b* and the hooking unit 64*a*. Thus, the separation preventing unit 64 not only slides at one side to adjust the space between the separation preventing unit 64 and the guiding groove 63, but is also attached or detached at the other side to thereby easily take in or out the string or wire 8 to the guiding groove 63.

Referring to FIG. 7, the separation preventing unit 64 may be inserted in the guiding groove 63 of the guider 6. In the fourth variant example, the separation preventing unit 64 is formed with an insertion hole 64*c* in which the string or wire 8 drawn out of the wrapping reel 7 is inserted. The insertion hole 64*c* may be achieved in the form of a through hole or a recessed groove. Although it is not illustrated, a lateral side of the separation preventing unit 64 and a corresponding lateral side of the guiding groove 63 may be formed with the sliding unit 64*b* or the hooking unit 64*a*, so that the string or wire 8 can be easily taken in or out to the insertion hole 64*c*.

The guider 6 can be attached to and detached from the second hinge shaft 62, and replaceable according to the thickness of the string or wire 8 wound round the wrapping reel 7. Alternatively, the separation preventing unit 64 in the fourth variant example may be replaceable according to the thickness of the string or wire 8 wound round the wrapping reel 7.

Below, an operation of the accessory wrapping machine according to an exemplary embodiment of the present invention will be described.

First, the wrapping reel 7 round which the string or wire 8 is wound is accommodated in the receiving groove 21 of the wrapping reel rotator 2. The holder 3 formed in the receiving groove 21 is inserted in the hollow of the wrapping reel 7. In this state, the string or wire 8 is drawn out of the wrapping reel 7 accommodated in the receiving groove 21 to the cutting portion 22 of the receiving groove 21, and then inserted along the guiding groove 63 of the guider 6. Then, the separation preventing unit 64 is used to close the guiding groove 63 and prevent the string or wire 8 inserted in the guiding groove 63 from separating from the guiding groove 63.

At this time, it is possible to open/close the receiving groove 21 by the cover 5 hinge-coupled to the wrapping reel rotator 2. In the case that the cover 5 closes the receiving groove 21 is closed by the cover 5, the second locking unit 65 of the guider 6 hinge-coupled to the wrapping reel rotator 2 and the first locking unit 55 of the cover 5 are engaged to lock the cover 5.

Then, the accessory member 9 passes through the aligned first, second and third through holes 11, 32 and 53. Here, the accessory member 9 passed through the foregoing through holes 11, 32 and 53 is surrounded and supported by the clamp unit 61 of the guider 6 formed on the same line as the foregoing through holes 11, 32 and 53. At this time, an end part of the string or wire 8 may be stuck on the accessory member 9 by glue. Then, the wrapping reel rotator 2 is rotated by the applied power and the operation of the switch 41, thereby wrapping the accessory member 9 with the string or wire 8.

Thus, the string or wire 8 inserted in the guiding groove 63 of the guider 6 stably moves along the guiding groove 63 by the separation preventing unit 64 without separating from the guiding groove of the guider 6 regardless of rotational speed of the wrapping reel rotator 2. Further, the spirally patterned guiding groove 63 makes the constant tension when the string or wire 8 is drawn out of the wrapping reel 7 and wrapped around the accessory member 9, thereby uniformly wrapping the accessory member 9 with the string or wire 8.

According to an exemplary embodiment of the present invention, there is provided an accessory wrapping machine capable of wrapping a string or a wire round an accessory so that a surface of the accessory geometrically changed from a ring or band shape material can feel a texture of material.

Also, there is provided an accessory wrapping machine allowing not only an expert but also a beginner to easily decorate an accessory with a string or a wire.

Further, there is provided an accessory wrapping machine which can reduce a decoration time taken in wrapping an accessory with a string or a wire and makes an outer appearance of a completed accessory beautiful.

Furthermore, there is provided an accessory wrapping machine in which a wrapping unit is easily replaceable and maintenance of the accessory wrapping machine is easy according to breakage or damage of the wrapping unit, so that it can be semi-permanently used.

Moreover, there is provided an accessory wrapping machine which can prevent a decorative string or wire drawn from a reel from getting tangled when a motor pauses and restarts in a process of wrapping the decorative string or wire round an accessory member, and wrap the accessory member with the string or wire uniformly and at constant tension.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. An accessory wrapping machine for wrapping a string or a wire around a band- or bar-shaped accessory member, the accessory wrapping machine comprising:

a gripper having a bracket protruding from a side of the gripper, the bracket having a first through hole through which the accessory member passes;

a wrapping reel rotator which is rotatably coupled to the bracket, and comprises a second through hole through which the accessory member passes, a receiving groove to receive a wrapping reel around which the string or wire is wound, and a cutting portion formed by partially cutting a lateral side of the receiving groove; and a guider which is hinge-coupled to a side of the wrapping reel rotator to open/close the cutting portion, and comprises a clamping unit formed at a free end thereof to hold and support the accessory member, a guiding groove spirally formed from the cutting portion along an outer surface of the guider to guide the string or wire wound around the wrapping reel, and a separation preventing unit to open/close the guiding groove.

2. The accessory wrapping machine according to claim 1, wherein the separation preventing unit is inserted in the guiding groove, and formed with an insertion hole in which the string or wire is inserted.

3. The accessory wrapping machine according to claim 2, wherein the separation preventing unit is hooking-coupled to the guider so that the separation preventing unit can be attached to and detached from the guider.

4. The accessory wrapping machine according to claim 2, wherein the separation preventing unit is sliding-coupled to the guider so that the separation preventing unit can slide in the guider to adjust a space between the guiding groove and the separation preventing unit.

5. The accessory wrapping machine according to claim 1, wherein the separation preventing unit is formed to surround the outer surface of the guider.

6. The accessory wrapping machine according to claim 5, wherein the separation preventing unit is hooked to the guider so that the separation preventing unit can be attached to and detached from the guider.

7. The accessory wrapping machine according to claim 5, wherein the separation preventing unit is sliding-coupled to the guider so that the separation preventing unit can slide in the guider to adjust a space between the guiding groove and the separation preventing unit.

* * * * *